United States Patent [19]

Voegeli

[11] Patent Number: 4,574,934

[45] Date of Patent: Mar. 11, 1986

[54] NEWSPAPER DISPLAY MACHINE

[76] Inventor: Ronald C. Voegeli, 918 Gibbs Rd., Venice, Fla. 33595

[21] Appl. No.: 696,338

[22] Filed: Jan. 30, 1985

Related U.S. Application Data

[62] Division of Ser. No. 530,787, Sep. 9, 1983, Pat. No. 4,506,776.

[51] Int. Cl.[4] ..... G07F 5/00

[52] U.S. Cl. ..... 194/248; 221/155

[58] Field of Search ..... 194/1 G, 54; 221/155, 221/112, 17; 312/234; 40/10 D, 156, 152, 10 R

[56] References Cited

U.S. PATENT DOCUMENTS

| | | | |
|---|---|---|---|
| 1,256,518 | 2/1918 | Carlon | 40/156 |
| 3,747,733 | 7/1973 | Knickerbocker . | |
| 3,870,136 | 11/1975 | Voegeli . | |
| 4,131,213 | 12/1978 | Tamura et al. | 221/155 X |

*Primary Examiner*—Stanley H. Tollberg

*Attorney, Agent, or Firm*—Burns, Doane, Swecker & Mathis

[57] ABSTRACT

A newspaper display machine has a container and an access door pivotably mounted to the container. The door includes a transparent window large enough to expose the full length and full width of a newspaper. A pair of pressure plates are pivotably mounted on the inside of the door for retaining a display newspaper against a rear surface of the window. Closure springs bias the pressure plates and access door to their closed positions. The container is provided with retainer openings which receive lower corners of the pressure plates when the pressure plates and the access door are all in their opened positions, in order to hold-open the pressure plates and access door against the closure biases of the springs.

6 Claims, 10 Drawing Figures

22
18
10
34
32
34
14
28
32
50
50
54
36
36
54
15
15

22
18
10
34
34
28
30
42
26
44
44
32
32
36
36
28
40
54
54
40

NEWSPAPER DISPLAY MACHINE

This application is a division of application Ser. No. 530,787 filed Sept. 9, 1983, now U.S. Pat. No. 4,506,776.

BACKGROUND AND OBJECTS OF THE INVENTION

The present invention relates to newspaper display machines of the type wherein a customer deposits coins in a coin slot and is able to open an access door of a newspaper container to remove a newspaper.

Newspaper display machines of this type are quite common. The access door typically includes a transparent window and a support structure which supports a display newspaper behind the window so that passing customers can view the newspaper on sale. The window is typically large enough to enable only a top half of the newspaper to be viewed, possibly due to the difficulty involved for delivery personnel in inserting and/or supporting the full newspaper length while trying to simultaneously hold open the spring-biased access door and/or the paper support structure.

It is, therefore, an object of the present invention to enable a display newspaper to be easily positioned behind a full-length window of a display container.

Another object is to enable the access door and/or display paper support structure of a newspaper display machine to be conveniently held in an open condition while loading or unloading newspapers.

A further object is to provide a novel display paper support which enables a display newspaper to be held behind a window of an access door in a full-length condition.

SUMMARY OF THE INVENTION

These objects are achieved by the present invention which relates to a newspaper display machine which comprises a container for housing a supply of newspapers, and an access door pivotably mounted at a front side of the container for rotation between open and closed positions about a generally horizontal axis disposed along a lower edge of the door. The door includes a transparent window having a height and width substantially commensurate with the full height and full width dimensions of newspapers being sold from the mechanism. A lock mechanism is provided on the container and door for locking the door to the container in the closed position of the door, and for unlocking the door in response to the depositing of preselected coinage. A first closure spring biases the door toward its closed position. At least one pressure plate is mounted on an inner side of the door for swinging movement toward and away from the window between closed and open positions, respectively. A second closure spring biases the pressure plate toward its closed position to press a full-length display newspaper against an interior surface of the window. A retainer is provided on the container for engaging the plate when the plate and door are both in their open positions, to releasably retain the door and plate in their open positions against the closing biases of the first and second springs.

Preferably, the pressure plate is mounted for rotation about a generally vertical axis disposed adjacent an edge of the window.

Preferably, the retainer comprises a hole into which a portion of the pressure plate fits.

THE DRAWING

The objects and advantages of the invention will become apparent from the following detailed description of a preferred embodiment thereof, in connection with the accompanying drawings, in which like numerals designate like elements, and in which.

DETAILED DESCRIPTION OF A PREFERRED EMBODIMENT OF THE INVENTION

Figure 1:
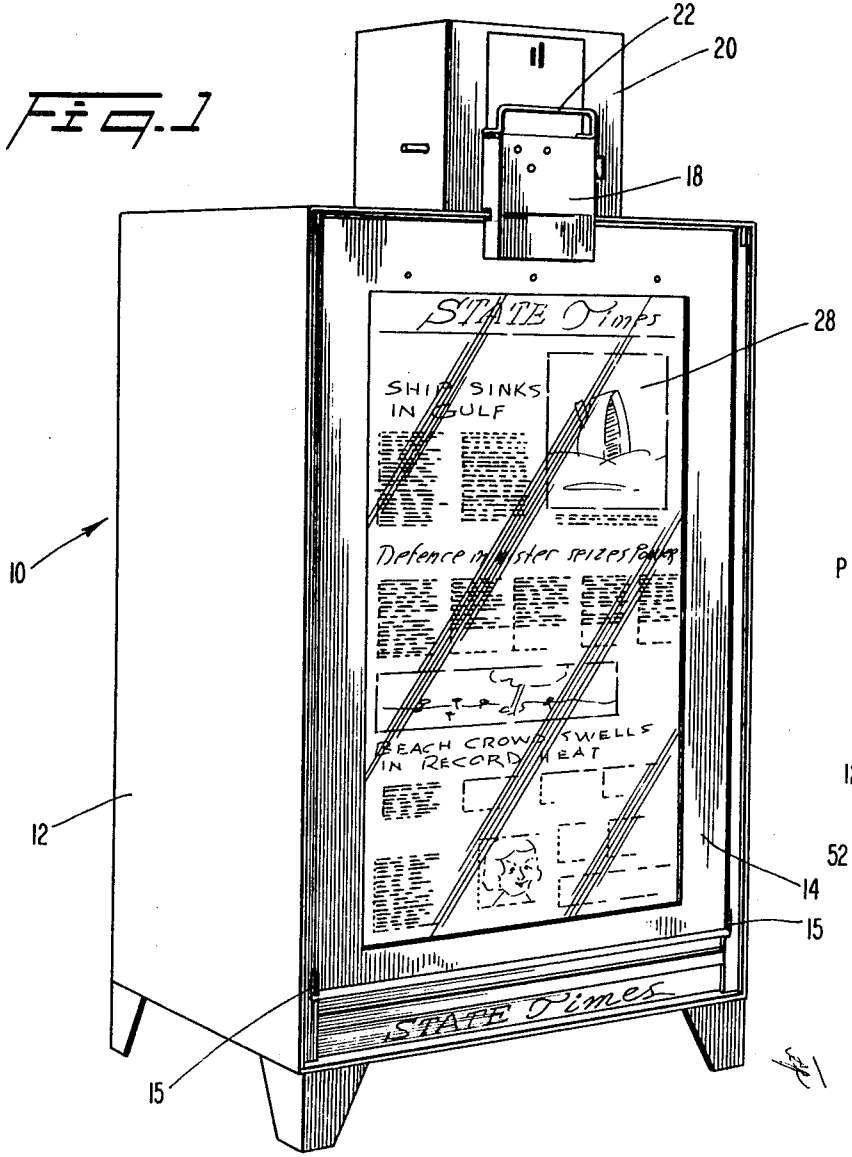
FIG. 1 is a perspective view of a newspaper display machine in accordance with the present invention, with the access door thereof in a closed position.

A newspaper display machine 10 according to the present invention is depicted in FIG. 1. The machine comprises a container 12 to which is hinged an access door 14. The door 14 is hinged along its lower edge to the container by a horizontal rod 15 (FIG. 3), such that the top edge of the door is swingable between open and closed positions about a horizontal axis of rotation.

A latch 16 is carried by a bracket 18 which is affixed to the upper edge of the door. The latch 16 is insertable into a coin-actuated locking mechanism 20 so as to be locked until proper coinage is inserted into the locking mechanism 20. The locking mechanism 20 can be of any suitable type, such as the conventional type disclosed in U.S. Pat. No. 3,870,136 issued to H. C. Voegeli on Mar. 11, 1975, the disclosure of which is incorporated by reference herein.

Figure 2:
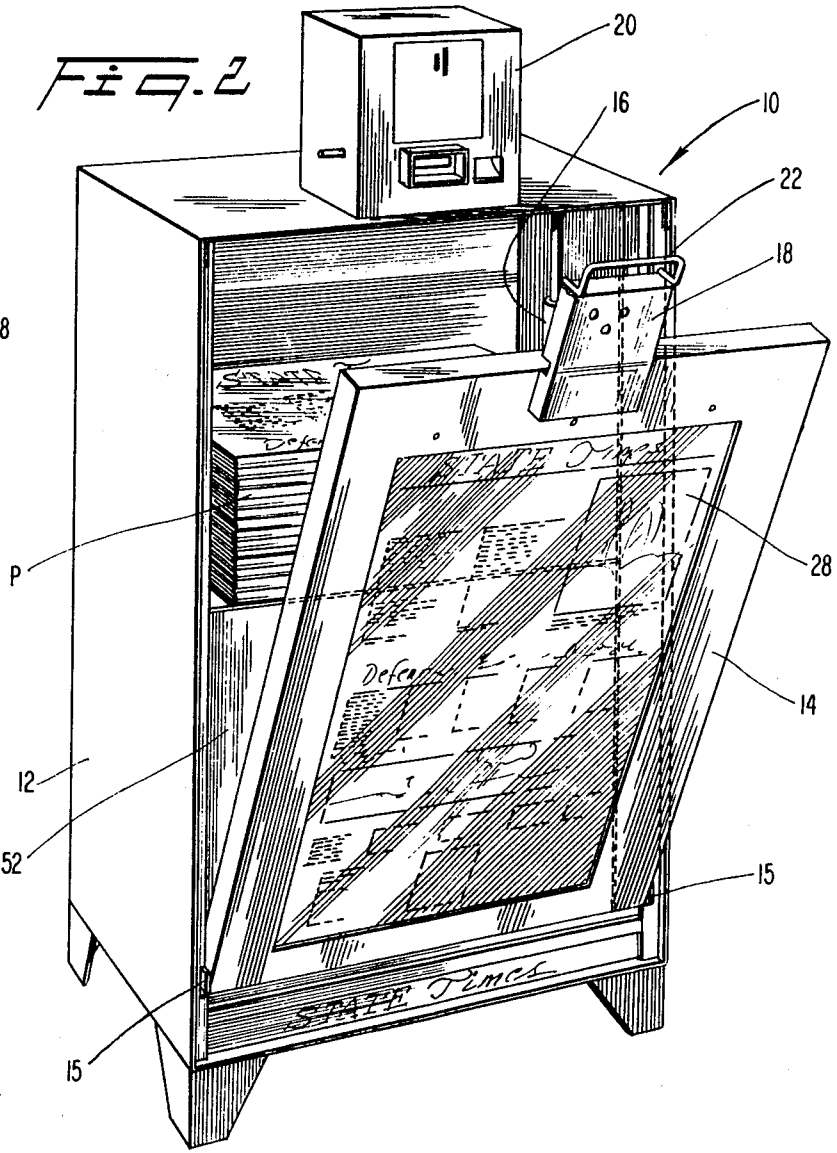
FIG. 2 is a view similar to FIG. 1, with the access door in an open condition.

When the door 14 is opened by a customer who pulls upon a handle 22 on the bracket 18, access to the container is gained, whereby a newspaper can be removed by the customer (FIG. 2).

The access door is biased to a closed condition by means of a spring, preferably a conventional coil tension spring 24 (FIG. 5) which acts between the container and a bar 26 affixed to the door.

A transparent window 28 is carried by the door 14 to enable a display newspaper to be exposed for viewing by passing customers. In accordance with the present invention the height and width of the window are substantially commensurate with the full height and full width dimensions of newspapers being sold from the mechanism. Accordingly, the display paper P which is inserted behind the window can be displayed in a full-height condition. The height of the window is thus preferably at least 19 inches and most preferably at least 22 inches.

Figure 4:
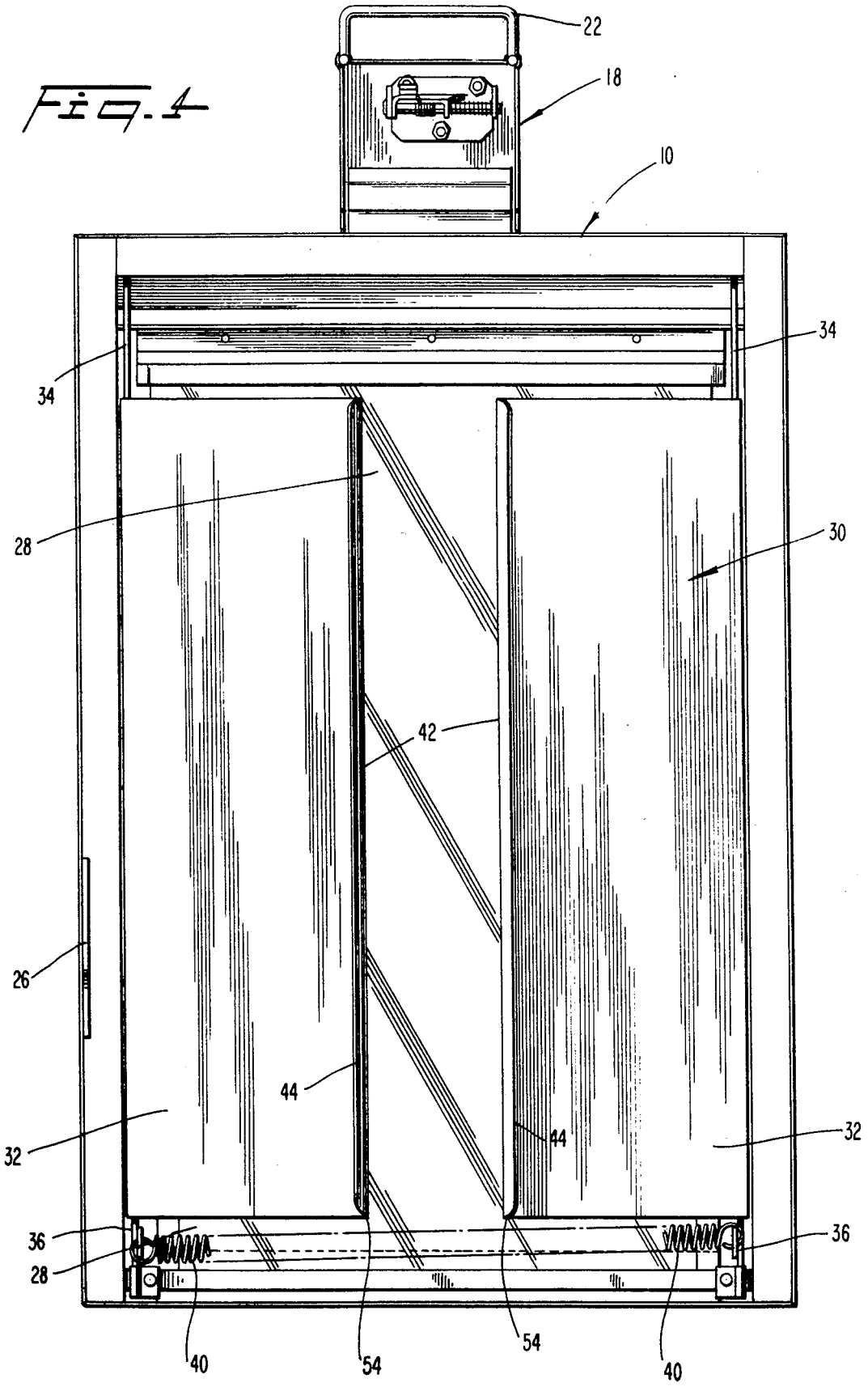
FIG. 4 is a rear elevational view of the access door as viewed from the inside of the newspaper display machine.

Mounted on the door 14 behind the window 28 is a display newspaper support mechanism 30 (FIG. 4). Preferably, that support mechanism comprises a pair of swingable pressure plates 32 which are each hinged along opposite vertical edges of the window for swinging movement about vertical axes. The vertical axes are defined by upper and lower pins 34, 35 which are attached to each plate and supported in the container 12 for rotation about their own longitudinal axes. Affixed to the lower pins 36 are lugs 38 to which are attached the ends of a coil tension spring 40. The spring 40 thus extends horizontally along the lower edge of the door and defines a plate-closing device. That is, when the plates 32 are swung away from the window 28 to opened positions (FIG. 9), the spring 40 is tensioned and thus biases the plates closed.

Each plate extends vertically substantially the full height of the window 28, and extends horizontally between $\frac{1}{3}$ and $\frac{1}{4}$ the horizontal width of the window. In the preferred embodiment, the inner edges 42 of the plates 32 are spaced slightly apart when the plates are in a closed condition.

The inner edges 42 of the plates are preferably folded-back at 44 to form a rounded surface which bears against the display newspaper.

It will be appreciated that each of the plates 32 will press against a substantial portion of the height of the backside of a full-length display newspaper to press same firmly against the back of the window. Thus, the exposed front page will be undistorted and easily inspected by passing customers. Due to the relatively large size of the plates 32, the plate-closure spring 40 must be relatively strong to close the plates and hold them tightly against the display newspaper.

Figure 3:
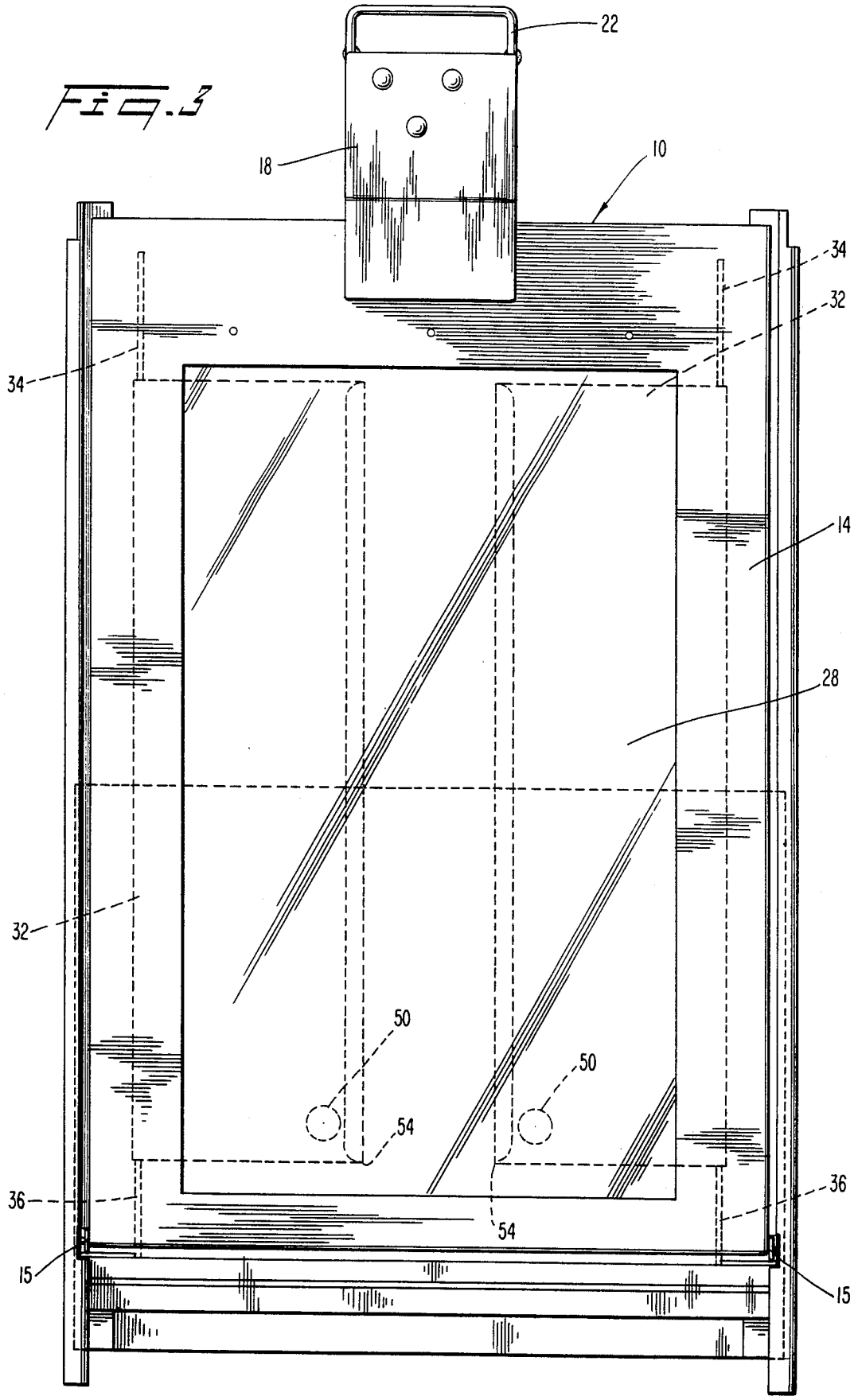
FIG. 3 is a front elevational view of the newspaper display machine.
Figures 5, 6, 7:
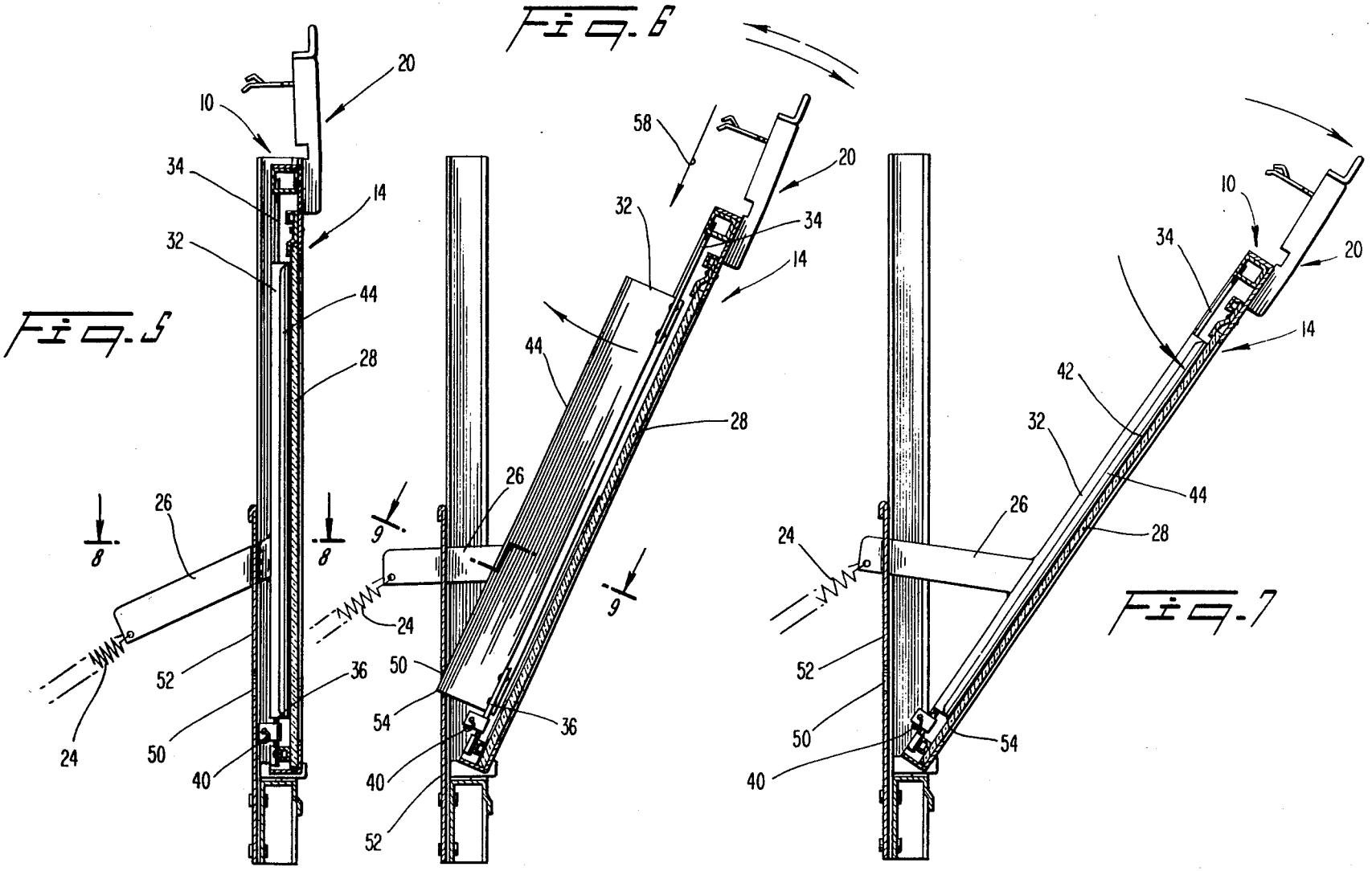
FIG. 5 is a vertical sectional view taken through a front portion of the newspaper display machine, with the access door thereof in a closed position.
FIG. 6 is a view similar to FIG. 5, with the pressure plate being in engagement with the retainer holds to hold both the pressure plates and the access door in their open positions.
FIG. 7 is a view similar to FIG. 6 after the access door has been slightly opened to a greater extent to allow the pressure plates to slam shut.
Figure 8:
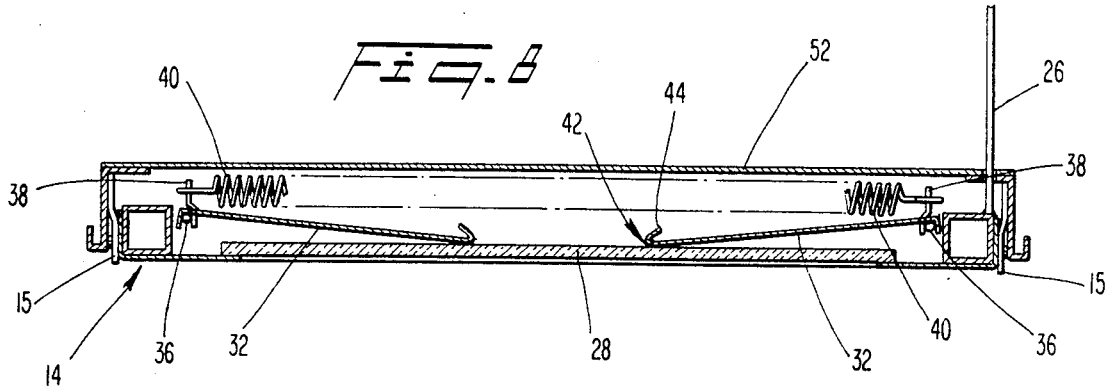
FIG. 8 is a horizontal sectional view taken along line 8—8 of FIG. 5.
Figure 9:
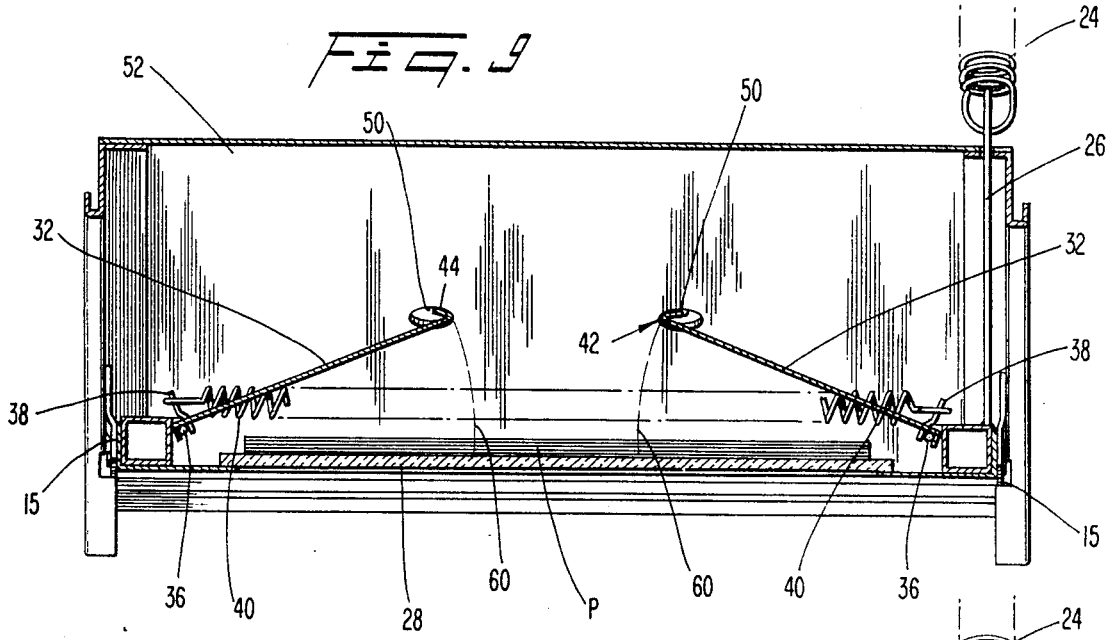
FIG. 9 is a horizontal sectional view taken along line 9—9 of FIG. 6.
Figure 10:
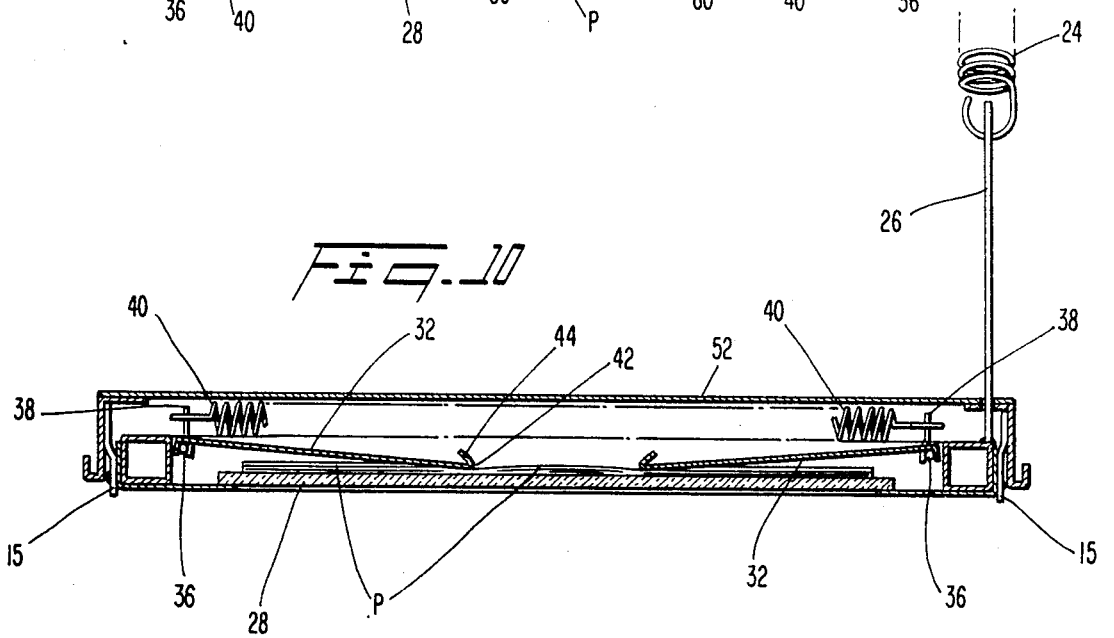
FIG. 10 is a horizontal sectional view similar to FIG. 8, but depicting a display newspaper being held in position by the pressure plate.

It will be appreciated that when a newspaper delivery person loads the access door 14 with a display newspaper, it is necessary to simultaneously (i) hold the access door open against the bias of the door closure spring 24, (ii) hold both plates 32 open against the bias of the plate-closure spring 40, and (iii) insert the display paper behind the window 28. The difficulty for a single person to perform this task is evident. However, in accordance with the present invention, this task is simplified. That is, a pair of openings 50 are provided in a stationary wall 52 of the container 12 (FIGS. 3, 5, and 9). The wall 52 is vertically oriented and disposed behind a lower portion of the access door 14, as viewed in FIG. 2.

The holes 50 constitute plate retainers which hold-open the plates 32 as well as the access door 14. That is, the holes 50 are located such that with the access door 14 and the plates 32 in opened conditions, the lower corners 54 of the inner edges of the pressure plates 32 are able to enter the holes 50, as depicted in FIGS. 6 and 9.

FIG. 9 represents a view seen when looking at the display machine in the direction of arrow 58 in FIG. 6, i.e., in a direction parallel to the swung-open door 14. When the access door 14 is open, and the lower corners 54 of the open plates 32 are inserted within the holes 50, the access door 14 can be released without any danger of the door 14 or plates 32 closing by themselves. That is, viewing FIG. 9, it will be appreciated that in order for the plates 32 to close, the inner edges 42 thereof must each traverse a curved path represented by a phantom line 60, which line is generated about the axis of the pins 36 as a center of rotation. However, the lower corner 54 of the plate projects into the hole 50 and is locked-in against the side of the hole as depicted in FIG. 11. Thus, not only are the plates 32 unable to close, but the access door 14 also cannot close since the latter can only be in a closed condition if the plates 32 are in closed positions. Therefore, despite the presence of substantial spring forces from the closure spring 24 and 40, the access door 14 and pressure plates 32 will be held open, enabling a delivery person to position a display newspaper behind the window. Once the display newspaper is in place, the delivery person need merely pull the access door further open, whereupon the corners 54 of the pressure plates are pulled out of the holes so that the plate closure spring 40 slams the plates closed against the backside of the full-length display newspaper. Then, the delivery person can release the access door 14 to enable the door closure spring 24 to close the door.

It will be appreciated, then, that the present invention provides a newspaper display machine which enables the full length of a newspaper to be displayed through a transparent window. This display newspaper can be easily installed by a single delivery person due to the retaining mechanism which holds the pressure plates and the access door in opened positions against the biases of the closure springs.

Although the present invention has been described in connection with a preferred embodiment thereof, it will be appreciated by those skilled in the art that additions, modifications, substitutions, and deletions not specifically described, may be made without departing from the spirit and scope of the invention as defined in the appended claims.

What is claimed is:

1. A newspaper display machine comprising:

a container for housing a supply of newspapers, an access door pivotably mounted at a front side of said container for rotation between open and closed positions about a generally horizontal axis disposed along a lower edge of said door, said door including a transparent window, means on said container and door for locking said door to said container in said closed position of said door, and for unlocking said door in response to the depositing of preselected coinage, closure spring means for biasing said door toward its closed position, said window having a vertical height and horizontal width sized to display the full height and full width dimensions of the display newspaper, said height defining a long dimension of said window and said width defining a short dimension of said window, and holder means mounted on an inner side of said door and biased for swinging movement about a vertical axis toward said window to press a display newspaper against said window, said holder means including a vertical height which extends parallel to said long dimension of said window and being greater than one-half of said long dimension of said window.

2. A newspaper display machine according to claim 1, wherein said height of said window is at least 19 inches.

3. A newspaper display machine according to claim 2, wherein said height of said window is at least 22 inches.

4. A newspaper display machine according to claim 1, wherein said horizontal width of said holder means is no greater than one-half the horizontal width of said window, and including additional holder means mounted on an inner side of said door along an opposite edge therefrom relative to said first-named holder means, said additional holder means being biased for swinging movement about a vertical axis toward said window, said additional holder means including a vertical height extending parallel to said long dimension of said window and being greater than one-half of the long dimension of said window, said horizontal width of said additional holder means being no greater than one-half the horizontal width of said window.

5. A newspaper display machine according to claim 4 including spring means exerting a closure force which is common to both said first-named and additional holder means for biasing such holder means closed.

6. A newspaper display machine according to claim 5, wherein said spring means comprises a single coil tension spring operably connected to both said first-named and additional holder means.

* * * * *